US005611494A

United States Patent [19]

Williams

[11] Patent Number: 5,611,494

[45] Date of Patent: Mar. 18, 1997

[54] ISOLATED INTELLIGENT AND INTERRELATED CONTROL SYSTEM WITH MANUAL SUBSTITUTION

[76] Inventor: Robert M. Williams, 16 La Hacienda, Ladue, Mo. 63124

[21] Appl. No.: 491,355

[22] Filed: Jun. 30, 1995

[51] Int. Cl.[6] ..... B02C 19/00; B02C 25/00

[52] U.S. Cl. ..... 241/27; 241/33; 241/35; 241/36

[58] Field of Search ..... 241/33, 34, 35, 241/36, 27

[56] References Cited

U.S. PATENT DOCUMENTS

| | | | |
|---|---|---|---|
| 4,184,640 | 1/1980 | Williams | 241/34 |
| 4,478,371 | 10/1984 | Williams | 241/18 |
| 4,602,744 | 7/1986 | Williams | 241/30 |
| 4,653,698 | 3/1987 | Cooper et al. | 241/31 |
| 4,846,410 | 7/1989 | Jewett et al. | 241/31 |
| 5,095,827 | 3/1992 | Williams | 110/234 |
| 5,383,612 | 1/1995 | Williams | 241/34 |
| 5,386,945 | 2/1995 | Nose et al. | 241/30 |

*Primary Examiner*—John M. Husar

*Attorney, Agent, or Firm*—Polster, Lieder, Woodruff & Lucchesi, L.C.

[57] ABSTRACT

A boiler fuel distribution control system in which a boiler fuel demand signal is employed to regulate the rate of grinding of the fuel within predetermined limits of air supply so the grinding of the fuel material is accomplished at a desired mill grinding speed and within a fluid bed differential pressure across the grinding mill to maintain a supply of fuel adequate to keep up the desired boiler operation. It is also a system in which stand alone isolated control computer accessories can be temporarily manually adjusted to the control system until a replacement is available.

4 Claims, 2 Drawing Sheets

ISOLATED INTELLIGENT AND INTERRELATED CONTROL SYSTEM WITH MANUAL SUBSTITUTION

BACKGROUND OF THE INVENTION

1. Field of the Invention

This invention is directed to an isolated intelligent and interrelated control system to satisfy the demand of a boiler and in which a boiler demand signal is applied to control the rate of grinding of the fuel material and in which each isolated unit has manual substitute control which can be used in the event of a control unit failure to automatically or manually supply the boiler with ground fuel which has a desired temperature and particle size adequate to maintain desired boiler operation.

2. Description of the Prior Art

It is known that coal grinding apparatus for direct coal fired burners is regulated by a boiler computer which regulates the speed controlled roller grinding mills operated in cooperation with a speed controlled spinner separator which determines the particle size and coal feeder to match the burner requirements. Fuel feeders of the above type employ controls measuring fluid bed differential pressure across the roller mill resulting in an expression of the quantity of fuel in the grinding mill so the mill grinding rolls can perform efficiently in producing a satisfactory output.

The known examples of prior art are adapted to domestic installations while malfunctioning apparatus can be corrected or worked upon by service personnel who understand the apparatus operation. However, when such apparatus is selected for installations in non-English countries where foreign language directions apply, there is great difficulty in securing proper service results in the event of malfunctioning of any component of the system. At the present time domestic apparatus used in a non-domestic environment is difficult to service in the event of a breakdown of a control unit. Language barriers prevent prompt attention to problems that interfere with apparatus repair.

SUMMARY OF THE INVENTION

The object of the invention is to supply an isolated intelligent control system for operating any boiler without difficulty with respect to processing a fuel material in adequate quantity and having a useful particle size.

A further object of the invention is to associate any boiler equipped with a computer operated device that emits a readily understood signal representative of the desired boiler operating condition with a system of isolated stand alone control components that are able to automatically respond to the signal emitted by the boiler device, and in the event of a malfunction in the system of controls to switch over to a manual response during a time period when a replacement control component can restore the control system to automatic response.

An important object is directed to governing a mill grinding rate based on estimated mill speed so as to develop sufficient centrifugal pressure in the grinding rolls to crush the fuel so it meets the boiler demand.

A further object is directed to the mill grinding rate based on fluid bed pressure buildup in the mill and providing control over the mill speed so as to maintain a predetermined differential pressure value for any given mill speed.

Another object is to govern the speed of a mill spinner separator in an inverse relation to mill speed thereby maintaining substantially uniform particle size of the ground fuel material forming the fuel supply for a boiler.

A still further object of the invention is to obtain a regulation of the mill grinding speed which reacts to the quantity and quality of the fuel supply so that the grinding mill speed is representative of the quality of the fuel material received for grinding.

Other objects and related advantages of the invention will be set forth in the following detailed description relating to the following drawings.

BRIEF DESCRIPTION OF THE DRAWINGS

The invention is illustrated in the drawings, wherein.

DETAIL DESCRIPTION OF THE INVENTION

Figure 1:
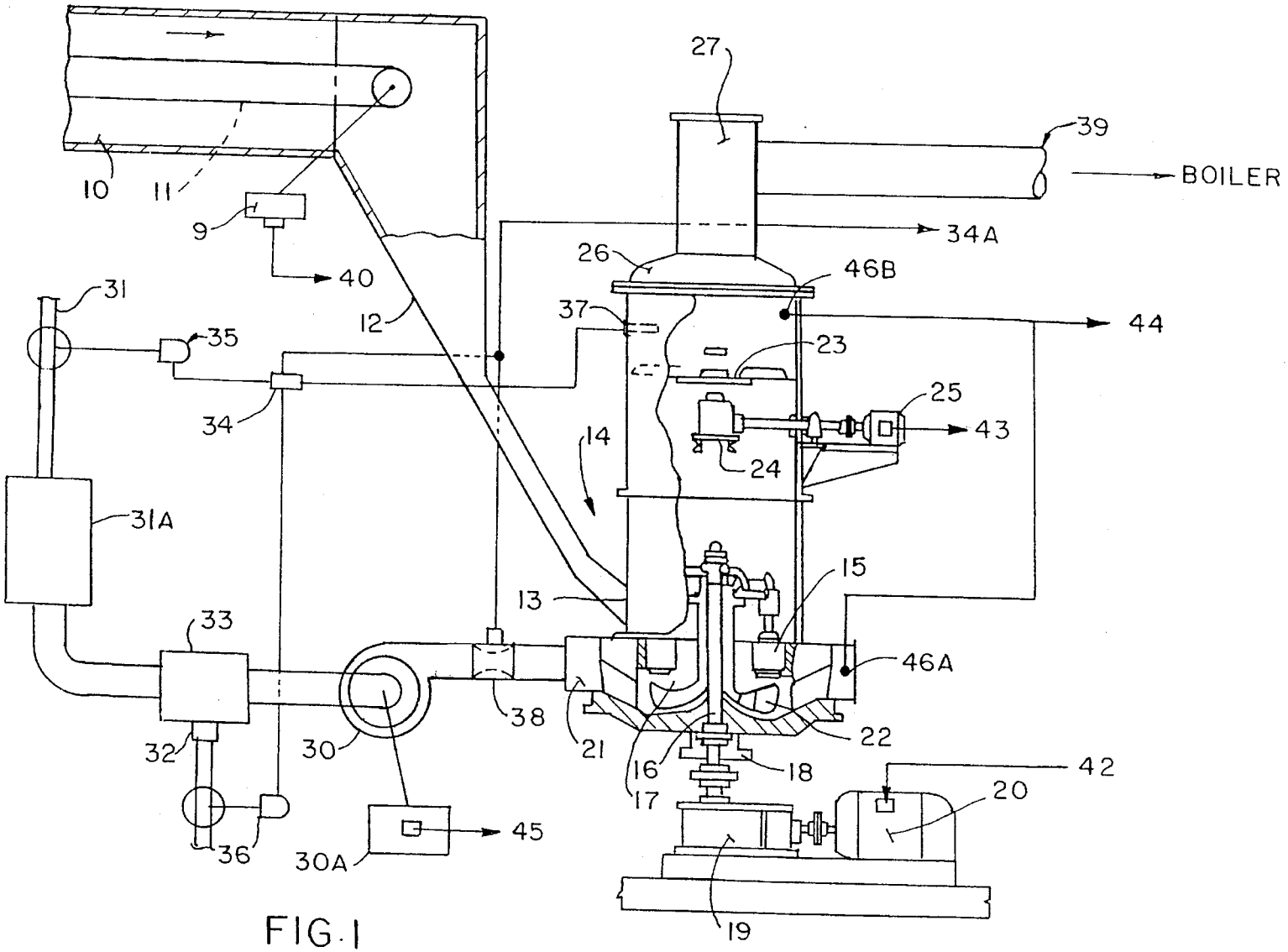
FIG. 1 is a diagrammatic and partial sectional view of fuel feeding and grinding apparatus for supplying a boiler.

The fuel grinding apparatus referred to above is exemplified in its preferred form in the several views of the drawings, and especially FIG. 1 wherein the coal constituting the fuel supply is introduced to housing 10 and delivered by a conveyor 11 into a chute 12 which directs the supply to the inlet 13 of a roller mill seen generally at 14. The material conveyor feeder 11 is driven by motor means schematically shown at 9. The mill grinding rolls 15 are mounted on a vertical drive shaft 16 extending into the grinding chamber 17 from a bearing assembly 18 connected to a transmission 19. The transmission 19 is directly powered by an electric motor 20. The mill chamber 17 is open to an air supply inlet 21 which directs the incoming air through a plow assembly 22 which lifts the ground material upwardly in the mill 14 and through the rolls 15 where it encounters a particle sizing rotary spinner separator 23 driven through a suitable gear 24 connected to an electric motor 25. The spinner allows the acceptable particle size of the ground material to pass through and exit at the mill outlet 26 to enter conduit 27. The total outlet can be directed by conduit 39 to a single boiler 28.

Figure 2:
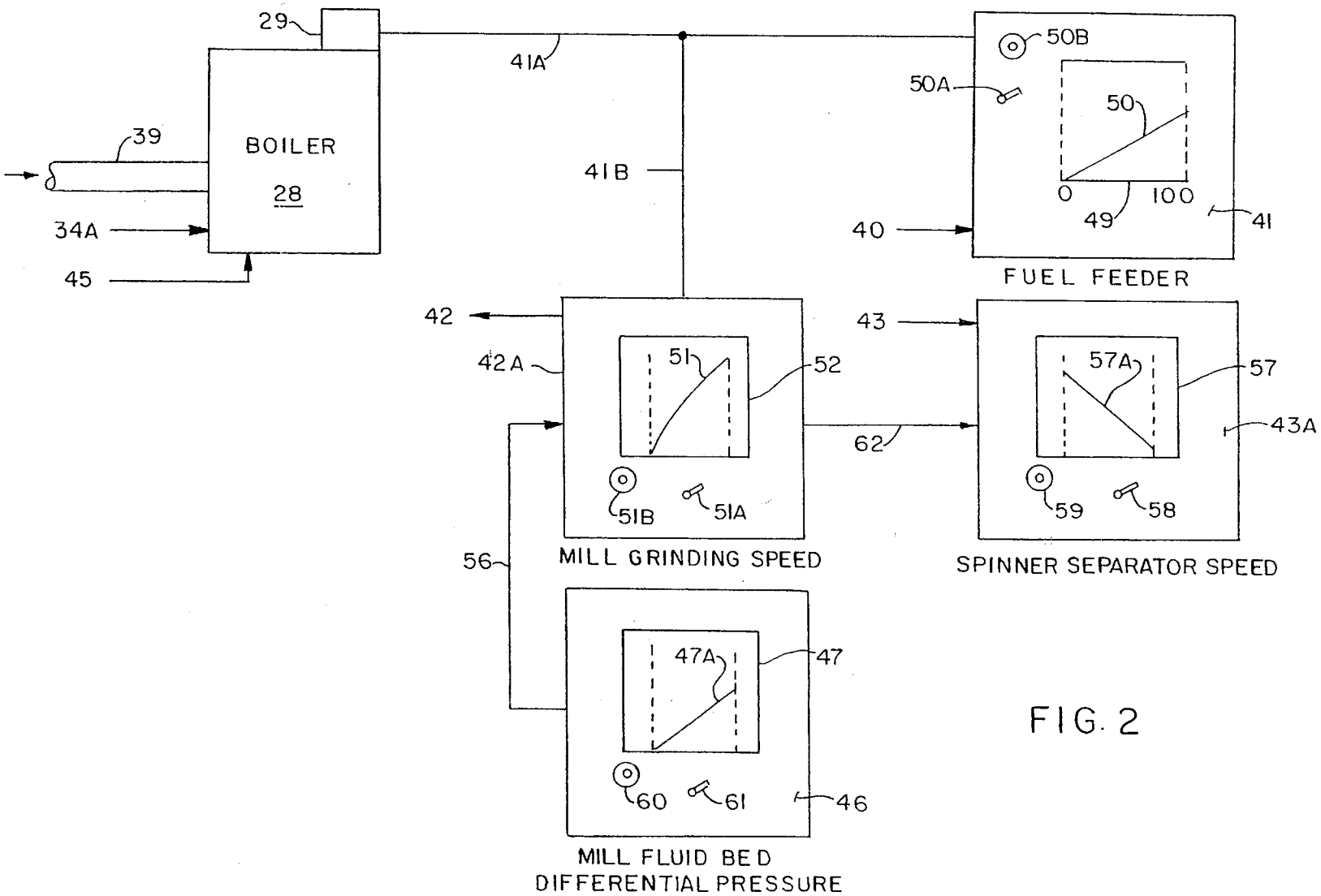
FIG. 2 is a system of components having isolated intelligent control circuits responsive to boiler demand with manual override in the event of failure of any circuit to perform.

In the view of FIG. 1, control connections are required leading to means described in FIG. 2. For example, the pressure across the mill 14 is transmitted by lead 44, connection 42 leads from motor 20, connection 40 leads from motor 9, and connection 43 leads from motor 25. A different lead 34*a* is connected from the temperature response of the air flow through the mill to the boiler seen in FIG. 2. It is convenient to show the control system in separate stand alone components which are responsive to a signal value representing the condition in the boiler.

Turning now to FIG. 2, it is observed that the boiler 28 has a computer device 29 to emit a demand signal selected to be in the range of 4 to 20 milliamps D.C. current. This signal range is adapted to be universal to activate the isolated control components making up the operative disclosure of FIG. 2. The object is to be able to install a boiler worldwide so it will be able to employ local sources of fuel. However, if the boiler is installed in a country that has little or no repair facilities and an important control requires repair or replacement, the boiler must be shut down until correction can be accomplished. This problem can be overcome by requiring the boiler to emit a signal that becomes universally understood and is related to a system of controls that can be supplied from several sources, and in addition to supply the initial controls with means to substitute manual control during a time when malfunctioning controls can be interrupted to permit repair or replacement without requiring boiler shut down.

Within the scope of this invention it can be assumed that the boiler 28 is operating on a supply of fuel delivered by a feed conveyor 11 driven by motor 9 which is connected by a suitable lead 40 to an isolated intelligent control component 41. The boiler demands fuel ground by a mill 14 operated by motor 20. That motor is connected by lead 42 to an isolated intelligent control 42A to grind the supply of fuel to a desired particle size determined through the spinner separator 23 driven by motor 25. That motor 25 is connected by lead 43 to an isolated intelligent component 43A. The particle size in the fuel is shown in the monitor 57 at chart 57A. That ground supply of fuel is carried by the flow of air from the fan 30 operated by motor 30A connected by lead 45 to the boiler 28. The air to fuel ratio is of the order of two pounds of air per one pound of fuel, and is supplied at a temperature of about 180° F. The boiler 28 is provided internally with means sensitive to the temperature of the air which delivers the ground fuel. That temperature is sensed at the mill 14 by a thermostat 37 connected to the junction device 34 (FIG. 1) which monitors the valves 35 and 36 to adjust the volume of heated air delivered with ambient air to carry the ground fuel. Any adjustment in the heat at heater 31A is made by a lead 34A connected into the boiler 28.

A further control embodies the provision of pressure sensors 46A and 46B across the mill inlet from the fan 30 and the ground fuel carried by heated air at the outlet of the mill 14. That differential pressure in the mill is a measure of the depth of the accumulation of fluidized ground material. That differential pressure reading is transmitted by lead 44 into an isolated intelligent component 46 where a monitor 47 displays a graph 47A. That component 46 is provided with a manual switch 61 and a dial 60 for use to remove that control component 46 and allow for a manual adjustment in that control 46.

It can be understood from the foregoing details of the system that a signal from the boiler device 29 will continue to demand the supply of the air carried fuel delivered to the boiler 28 from conduit 39 at a temperature in the mill 14 as measured by the thermostat 37. In normal operation of the boiler 28 to be supplied with fuel at a temperature reading at thermostat 37 and the character of the fuel being supplied by the conveyor motor 9 and ground by the mill 14. If there happens to be a change in the character of the fuel to the boiler there can be expected to have a change in the value of the signal from unit 29 within the 4 to 20 milliamp D.C. current. The response of the boiler will be to demand a fuel rate and the response will be a change in the current in lead 41A received at the fuel feeder control 41, and a change in the current in lead 41B which signals the mill motor 20 to grind slower or faster. The change in the grinding speed at mill motor 20 will be accompanied by an appropriate response by the components 41, 42A, 43A and 46.

However should any one of the components fail to perform its control function in response to the signal from the boiler, that would normally call for a shut-down of the boiler 28. In this control system provision has been introduced so that all an attendant needs to do is to determine which one of the controls has failed in its intended function. Having done that the malfunctioning control can be interrupted or converted by manual actuation of the associated switch 50A, 51A, 58 and 61 so that continued operation of boiler 28 can be adjusted by the respective one of manual dials 50B, 51B, 59 and 60. It is not expected that all of the controls will develop a malfunction, but whichever control has failed controls can be actuated to go into manual response so the system continues to function.

The individual stand alone controls 41, 42A, 43A and 46 are made with the necessary intelligent circuitry to be activated from the boiler signal from unit 29. Thus the fuel feeder control 41 embodies internal circuits responsive to the signal received from lead 41A to adjust the feed of fuel by governing the conveyor motor 9 to feed more or less fuel to the mill 14. The signal from boiler unit 29 also goes to the mill grinding speed control 42A from lead 41B to govern the internal circuits which resulting in a signal through lead 42 to vary the speed of mill motor 20 grinding the fuel material faster or slower. A change in the grinding speed at the mill 14 is related to a feed back function in control 46 which is responsive to the quantity of unground fuel in the mill which is represented by the fluid bed differential pressure. Therefore, if the fuel is harder to grind the differential pressure will rise above a targeted point in graph 47A, and the feed-back will cause the motor 20 to grind faster to increase the grinding capacity so as to match the fuel feed rate from the feeder control 41. If the fuel is easier to grind the mill motor 20 will slow down the grinding rate.

Thus, the quality of the fuel introduced to the mill 14 can affect the grinding rate which must be adjusted to the boiler demand while maintaining a desired fluid bed differential pressure and a desired particle size. To accommodate the boiler demand the control system incorporates the differential pressure control component 46 and the spinner separator control component 43A into the mill grinding speed control component 42A. Thus, any change in the quality (different from quantity) of the fuel can affect the mill grinding function which may over fill the mill 14 if the grinding rate is too slow for the predetermined feed rate, in which event the fluid bed differential pressure will elevate to indicate unground material overloading the mill system. An opposite effect can be encountered if the differential pressure falls based on a coals grinding ability that is softer than anticipated.

It is noted above that the differential pressure in the mill imposes a feed-back effect on the mill. At the same time the spinner separator 23 in the mill is responsive to the stand alone control 43A to operate at a rate that will measure the particle size of the fuel being delivered to the boiler 28. The relationship of the spinner separator stand alone control 43 to the mill grind speed of stand alone control 42A is one in which as the grinding speeds up the spinner separator slows down to govern the particle size in the fuel delivery to the boiler 28. The reverse relationship is one in which when the grinding slows down the spinner separator speeds up to govern particle size.

The foregoing specification has set forth a preferred embodiment, but normal variations within the spirit of the teaching are to be included within the scope of the invention.

What is claimed is:

1. In a system having independent automatic multiple control components for taking over the management of the fuel supply for a boiler which emits a signal demanding a supply of ground fuel at a predetermined fineness and air to coal ratio, the system comprising:

a) individual stand alone controls having intelligent circuitry connected for activation by a boiler signal emitted to demand a supply of ground fuel at a predetermined fineness and air to coal ratio, said stand alone controls including:

1) a fuel feeder control having a substitute manual control therein;

2) a mill grinding speed control having a substitute manual control therein;

3) a spinner separator speed control having a substitute manual control therein;

4) mill fluid bed differential pressure control having a substitute manual control therein; and b) a boiler responsive computer device emitting a demand signal selected in a milliamp D.C. current range for the universal activation of any of said substitute manual controls in said stand alone controls in the event of malfunctioning in any of said automatic controls.

2. In the system set forth in claim 1 wherein each of said stand alone controls includes manually manipulative controls that are operative to interrupt the automatic response from any of said stand alone controls in the event of a malfunction therein.

3. For use in conjunction with a system of automatic multiple stand alone and interrelated controls associated with fuel grinding and particle sizing supply to a boiler emitting a fuel demand signal, a method of monitoring the stand alone controls while the system is in operation, said method comprising:

a) providing the multiple controls with monitoring screens for visually displaying the operation of such controls in response to the boiler fuel demand;

b) manually interrupting the automatic response of any control that displays a malfunction;

c) converting the malfunctioning control to a manual response in the system; and d) replacing a malfunctioning control so as to return to automatic response.

4. Apparatus for controlling the supply of fuel to a boiler which emits a fuel demand signal, the apparatus comprising:

a) a fuel grinding and fuel particle sizing mill connected in fuel delivery responsive association to a boiler emitting a fuel demand signal;

b) a plurality of individual stand alone components having control circuits automatically responsive to and operatively connected to said boiler demand signal; said components operating collectively to deliver fuel for said boiler, to grind the fuel, and to release fuel of a predetermined particle size to said boiler from said grinder; and c) manually manipulated controls in each of said individual stand alone components, said manually manipulated controls being operative to interrupt the automatic response of a control circuit in the event of a malfunction therein so as to continue operation of the apparatus.

* * * * *